United States Patent [19]

Engelskirchen et al.

[11] Patent Number: 4,765,378

[45] Date of Patent: Aug. 23, 1988

[54] VALVE STATION FOR INTERCONNECTING BOREHOLES IN A SEABED

[76] Inventors: Jurgen Engelskirchen, Contastrasse 3, 2000 Hamburg 20/BRD; Dieter Koenig, Dahlienweg 2, 2105 Seevetal 1/BRD, both of Fed. Rep. of Germany

[21] Appl. No.: 102,790

[22] Filed: Sep. 23, 1987

Related U.S. Application Data

[63] Continuation of Ser. No. 764,196, Aug. 9, 1985, abandoned.

[30] Foreign Application Priority Data

Aug. 20, 1984 [DE] Fed. Rep. of Germany ..... 3430628

[51] Int. Cl.[4] ..... B63B 22/02

[52] U.S. Cl. ..... 141/69; 114/230; 441/4; 441/5

[58] Field of Search ..... 114/230, 264; 141/9, 141/11, 69; 441/4, 5

[56] References Cited

U.S. PATENT DOCUMENTS

| | | | |
|---|---|---|---|
| 3,440,671 | 4/1969 | Smulders | 441/5 |
| 3,602,302 | 8/1971 | Kluth | 114/264 X |
| 3,664,388 | 5/1972 | Frankel | 441/4 X |
| 4,606,727 | 8/1986 | Koenig et al. | 441/5 |

FOREIGN PATENT DOCUMENTS

| | | | |
|---|---|---|---|
| 2012715 | 8/1979 | United Kingdom | 441/4 |

*Primary Examiner*—Mark J. Thronson

*Attorney, Agent, or Firm*—Sughrue, Mion, Zinn, Macpeak and Seas

[57] ABSTRACT

A valve station for interconnecting boreholes in a seabed has a buoy anchored to the seabed and secured to a tanker whereby the buoy serves to anchor the tanker. Valves are provided on the buoy for connecting a plurality of separate pipelines extending from the boreholes to a common pipeline on the tanker. The buoy has an upstanding pipe extending through a shaft space in the stern of the tanker to a swivel connecting the pipe to the common pipeline on the tanker.

4 Claims, 1 Drawing Sheet

VALVE STATION FOR INTERCONNECTING BOREHOLES IN A SEABED

This is a continuation of application Ser. No. 764,196, filed Aug. 9, 1985, now abandoned.

FIELD OF THE INVENTION

The present invention relates to a valve station for connecting a plurality of boreholes provided on a seabed for the extraction of oil and/or natural gas to one another and to at least one common pipeline.

DESCRIPTION OF THE PRIOR ART

In the offshore extraction of oil and/or natural gas, a plurality of boreholes are usually connected to one another so that the extraction speed for the individual boreholes can be individually regulated and, thus, so that the extraction from one borehole can be strongly throttled or entirely interrupted for a certain time, while a substantial amount, in total, is being extracted (from the other boreholes). Thus, during the extraction operation, gas, liquid or mud can be injected back into one of the boreholes during extraction from the other boreholes, in order to return waste substances to their point of origin or in order to stimulate further extraction.

Such a valve station can, for example, be installed on a drilling island, with a corresponding pipeline extending from the valve station to each of the boreholes. For that purpose, however, it is necessary for the drilling island to remain at a predetermined position in the oil or natural gas field, even after new borings have been put into operation.

The oil and/or natural gas is normally firstly conveyed to a securely anchored tanker, from which it can be transported. It is therefore hardly possible, or at least only possible by complicated and expensive technology, to arrange the valve station on the ship, since the pipelines from the individual boreholes to the valve station must all be connected by corresponding swivels because the tanker rotates into different directions in dependence on the direction of the wind or currents, so that connection with the boreholes located at the seabed must also be made rotatably. Since a very high pressure prevails in the pipelines (the high formation pressure), these swivels must also withstand a very high pressure. High pressure swivels, however, are of very complicated construction and are, accordingly expensive. Furthermore, it is not always possible to pass testing apparatuses, sensors, tools for pipeline cleaning and the like through them from the valve station.

Due to these difficulties, the valve stations have previously been arranged on the seabed. It is then, indeed, possible to connect a high pressure pipeline to the ship through one swivel. Since, however, the valves must be controlled on the seabed, hydraulic pipes must be connected through corresponding swivels. This, however, is not the main disadvantage.

The valve station arranged on the seabed can be maintained only by divers. Modifications due to alterations of extraction technology or policies are possible only to a very limited extent. The insertion of test apparatuses, sensors and cleaning tools into the individual pipes as far as the individual boreholes is very difficult. The entire extracted medium, including gas, mud, sand and water components, must be conveyed, in each case, through the single high pressure swivel, which requires the latter to be made with correspondingly large dimensions.

OBJECT OF THE INVENTION

It is accordingly an object of the present invention to provide a valve station of the first-mentioned type, which is simple to operate, maintain and modify and which simultaneously avoids the disadvantages of multiple high pressure swivels.

BRIEF SUMMARY OF THE INVENTION

According to the present invention, the valve station is arranged on a buoy which serves for anchoring a tanker.

The buoy is connected by a plurality of pipelines with respective boreholes. In the valve station in the buoy, the individual boreholes can be interconnected and connected to the tanker, as required, a high pressure swivel being required only for the connection to the tanker. The buoy itself is located at least partly above the water level, so that it is readily accessible. Thus, repairs, maintenance work and modifications can readily be carried out at the valve station.

If the valve station has closeable openings in its pipes, into which the test apparatuses, sensors, tools for pipe and borehole cleaning and the like can be inserted, the latter can be inserted in a simple manner into the valve station (this insertion must be effected at the valve station since the corresponding pipes are subjected to high pressure).

The valve station is advantageously provided with devices for examining and/or processing the medium being conveyed. Thus, for example, the medium extracted from the different boreholes can be examined before being mixed. The processing of the medium may, for example, be effected in separators for separating gas, water, oil and mud/sand. In this case, it is, in a particularly advantageous manner, no longer necessary to convey all components of the extracted medium through the high pressure swivel into the tanker. One can, for example, collect at least gas and mud/sand in the buoy in the vicinity of the valve station, if the buoy, in accordance with a preferred embodiment of the invention, is provided with tanks or other containers for holding portions of the extracted medium. In these containers, for example, the mud can be collected and during calm weather, thus when there is no relative rotation taking place between the buoy and the tanker, the mud can be conveyed by comparatively simple means into the tanker (for example with a normal suction hose). Advantageously the valve station is also provided with means for feeding back a portion of the extracted medium into the boreholes. Thus, for example, water and mud/sand can be injected back into the boreholes, since the storage in another manner of these waste products involves difficulties because they are contaminated with oil and since they must also be transported away from time to time on a barge. Also, this return injection of waste materials is not effected through the high pressure swivel.

Buoys to which a tanker is more or less permanently secured are known. The tanker, into which the extracted medium is firstly received, is rotatably secured by a fork-shaped jib to the buoy. A problem with this is that not only must a swivel be provided for rotary movement of the tanker about a vertical axis, but also a similar swivel must be provided by which relative movement between the buoy and the ship in a vertical plane can take place.

It is particularly advantageous if the buoy can be received in a corresponding shaft of a tanker and can be held so as to be rotatable about a vertical axis, as is taught in German Patent Application No. 3,344,166.2-22 in the name of the assignee of the present application. There is thus provided the advantage that the valve station, together with any further devices which may be provided for testing, separation etc., is particularly easily accessible, since the buoy is located in the body of the ship itself and does not need to be entered from the exterior through the fork connection. Furthermore, the buoy, together with the valve station, which may be fragile, is better protected in this way against collisions. Also, heavy replacement components can, of course, be more easily handled within the stern of the ship then if they had to be brought over the fork connection to a buoy located overboard. In addition, in the case of heavy valve stations with heavy processing machinery, few buoyancy problems occur for the buoys, since the latter can be carried by their ships.

The shaft preferrably extends to below the waterline of the tanker. In this case, during a sea voyage the buoy can be partly raised from the water so that holding devices in the shaft for securing the buoy do not need to be dimensioned to support the total weight of the buoy. Also, during passage through ice, there is no danger that the comparatively thin and fragile extraction pipes or hoses will be raised from the water and then come to contact with ice and become damaged or destroyed. The shaft may, moreover, be so arranged that the buoy always floats in ice-free water. In that connection, it is advantageous for the buoy to be incorporated in a bow or stern part of a ship which is constructed or reconstructed so as to be ice-resistant.

If the shaft extends to below the waterline, it is advantageous to be able to blow sea water from parts of the shaft by means of compressed air. In that case, by corresponding devices (air locks and the like), parts of the shaft can be made accessible to maintenance personnel and, in fact, when the sea water is blown out by means of compressed air, parts which lie below the water line can thus be made accessible.

As mentioned herein above, the valve station can be modified, and thus the valve station or buoy can be adapted to new extraction technology or policies. Even greater versatility can be obtained if the buoy can be connected directly in the oil field to the tanker or can be connected to another tanker. For this purpose, the buoy is preferrably equipped with a ballast system, and is also provided with a coupling device which allows the buoy to be submerged together with an anchoring and wholly or partly preloaded chain of a prepared tanker and to be moved into the prepared shaft in which, finally, it is securely coupled.

For this purpose, it is preferrably provided that the buoy is again releasable from the shaft. Thus, for example, at the beginning of winter, when icebreaking is risky, the buoy can be removed from the shaft and by means of its ballast system can be kept in suspension at a safe depth below the surface of the sea, beneath the ice, by the weight of the anchor chain. The tanker itself can, meanwhile, be moved to a different location. In the spring, the buoy suspended below the water surface can be located and again brought to the surface of the water and inserted into a tanker.

BRIEF DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENT

Figure 1:
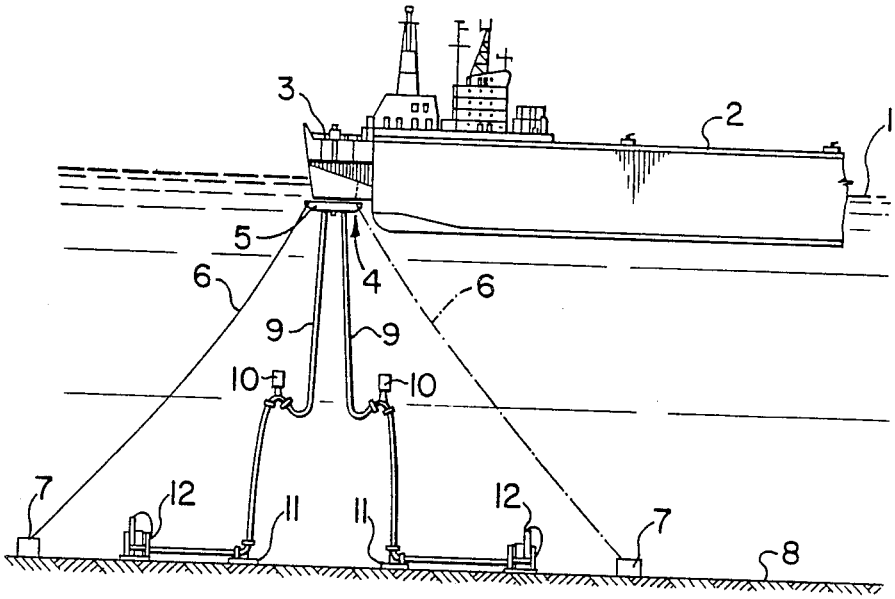
FIG. 1 shows a tanker connected to a buoy anchored to the seabed and to boreholes by hose or pipelines.

In FIG. 1, there is shown a tanker 2 floating on a water surface 1 and a buoy 4 inserted into the stern 3 of the tanker. The buoy 4 includes a lower platform 5 located at the exterior of the tanker 2.

Anchor cables 6 are secured to the platform 5 of the buoy and are connected by anchors 7 to the seabed 8.

Furthermore, two feed pipes 9, which are suspended at predetermined heights in the water by floats 10 and which are connected by guide devices 11 to boreholes 12, extend from the buoy 4. The boreholes 12 include valves which do not form part of the present invention and are therefore not described herein in greater detail.

Figure 2:
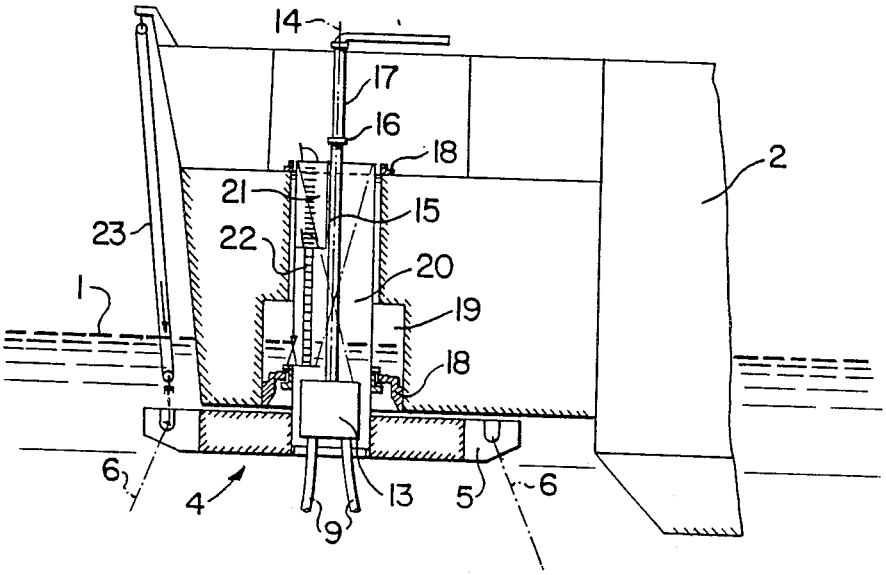
FIG. 2 is an illustration in greater detail of the buoy arranged in the tanker shown in FIG. 1.

The actual valve arrangement for connecting the feed pipes and a pipe 15, which is schematically illustrated in FIG. 2 and indicated by reference numeral 13, is located in a lower portion of the buoy 4. This valve arrangement 13 may be provided with further devices, such as, for example, testing devices, processing devices such as separators, containers or tanks for portions of the extracted medium and devices for injecting portions of the extracted medium back into the boreholes as described hereinabove, and is selectively operable to control flow between the pipes and the pipe 15.

The pipe 15 extends from the valve arrangement 13 in the direction of a vertical axis of rotation 14, about which the buoy 4 can rotate, the pipe 15 being connected by means of a high pressure swivel 16 to a stationary pipe 17, which extends to tanks (not shown) on the tanker 2. If the tanker rotates relative to the buoy, then the pipe 17 also rotates with the tanker, while the pipe 15 on the buoy remains stationary. The buoy 14 is rotatably secured to the tanker by interengaged upper and lower bearings 18 on the buoy 4 and the tanker 2, the bearings retaining the buoy 4 in a predetermined position relative to the tanker 2 at the underside of the tanker 2 and in coupled relationship with a downwardly open shaft 19 in the tanker 2 for movement with the tanker 2 while allowing rotation of the tanker 2 about the buoy 4.

As can be seen from FIG. 2, the water surface 1 is located within the shaft 19, into which the buoy 4 is received, at such a height that the buoy or a tower-like upper part 20 of the buoy, around which the bearings 18 extend, is partly immersed in the water with the upper part projecting upwardly beyond the water level in the shaft 19. To enable the buoy to be better inspected (and for example to enable the lower bearing 18 to be inspected), this water can be expelled by means of air pressure. The buoy itself, or the space in which the buoy is located, can be entered through access means in the form of an air lock 21 and a ladder 22 provided above the water level in the shaft 19, so that the valve arrangement be manually operated, although of course remote control from the tanker is possible, which can be effected by substantially simpler means than in the case of a valve arrangement at the seabed. The other substantial advantage comprises, however, in that the valve arrangement can be maintained, repaired or modified.

Reference numeral 23 indicates devices in the form of chains, lifting tackle and the like by means of which the buoy can be raised in order to be stably secured relative to the tanker.

We claim:

1. In combination for off-shore extraction of oil:

a tanker;

a submerged floating buoy;

means for anchoring said buoy to a seabed and means for connecting said buoy to said tanker for mooring said tanker;

said tanker having means defining a downwardly open shaft space therein for receiving said buoy;

said connecting means comprising interengaged bearing means on said buoy and said tanker for retaining said buoy in a predetermined position relative to said tanker at the underside of said tanker and in coupled relationship with said shaft space for movement with said tanker while allowing rotation of said tanker about said buoy;

a plurality of separate first pipeline means for separately connecting said buoy to respective boreholes on said seabed;

second pipeline means for connecting said buoy to said tanker;

high pressure swivel means for rotatably connecting said buoy to said second pipeline means; selectively operable valve means located within said buoy and within said shaft space for separately controlling flow between individual ones of said first pipeline means and said second pipeline means;

said selectively operable valve means including means for testing and processing an extracted medium flowing through any of said first pipeline means; and means on said buoy for providing access to said valve means through said shaft space for maintenance and repair of said valve means.

2. The combination of claim 1, wherein said buoy comprises an upper portion thereof which projects upwardly beyond the water level in said shaft space, said means for providing access being located on said upper portion above said water level.

3. The combination of claim 2, wherein said bearing means comprise a pair of bearings spaced apart along said shaft space and extending around said upper portion of said buoy.

4. The combination of claim 1, wherein said buoy further comprises pipe means extending upwardly from said valve means for connecting said valve means to said swivel means.

* * * * *